US006113475A

United States Patent [19]

Masuda et al.

[11] Patent Number: 6,113,475

[45] Date of Patent: Sep. 5, 2000

[54] METHOD OF CLEANING CONTAINER AND APPARATUS THEREFOR

[75] Inventors: Takayuki Masuda; Kiyoyuki Okamoto; Masumi Yoshida, all of Amagasaki, Japan

[73] Assignee: Daiko Electric Co., Ltd., Osaka, Japan

[21] Appl. No.: 09/408,851

[22] Filed: Sep. 30, 1999

[30] Foreign Application Priority Data

Dec. 24, 1998 [JP] Japan ..... 10-378427
Mar. 30, 1999 [JP] Japan ..... 11-129004

[51] Int. Cl.[7] ..... B24C 3/16

[52] U.S. Cl. ..... 451/76; 451/83; 451/102

[58] Field of Search ..... 451/76, 83, 102, 451/39, 40, 75

[56] References Cited

U.S. PATENT DOCUMENTS 2,601,746 7/1952 Clark ..... 451/76
2,641,839 6/1953 Black ..... 451/102
2,763,964 9/1956 Luce ..... 451/75
5,255,853 10/1993 Munoz ..... 451/102
5,536,200 7/1996 Kliess ..... 451/102

FOREIGN PATENT DOCUMENTS 0046455 6/1936 France ..... 451/83
0662334 5/1979 U.S.S.R. ..... 451/76

*Primary Examiner*—Robert A. Rose
*Attorney, Agent, or Firm*—Ronald E. Greigg; Edwin E. Greigg

[57] ABSTRACT

A method of cleaning a container and an apparatus therefor for cleaning a surface layer of the container by blasting fine particles of sodium bicarbonate with pressurized air into the container. The apparatus provdes a ball joint construction and a nozzle angle control mechanism for swing a nozzle body at an angle within a range of 50 degrees.

4 Claims, 13 Drawing Sheets

Relationship between spray speed of mixure and diameter of fine particle of sidium bicarbnate Spray distance: 205 mm 1: Case of relatively low viscosity of cleaning material 2: Case of relatively high viscosity of cleaning material 1: Case of relatively low viscosity of cleaning material 2: Case of relatively high viscosity of cleaning material

METHOD OF CLEANING CONTAINER AND APPARATUS THEREFOR

BACKGROUND OF THE INVENTION (1) Field of the Invention

This invention relates to a method of cleaning a container and an apparatus therefor, and to be more specific, the present invention relates to the method of cleaning the container and the apparatus therefor for washing stain off the container which contains all kinds of ink, resinous paint and so on, and for washing dirt off a food container.

(2) Prior Art

For example, a container such as a drum which contains resinous paint and so on, may often be reused to mix or to dilute some kinds of ink, etc. in addition to an original use for containing all kinds of ink or resinous paints and so on to be carried.

In these occasions, the ink, etc. originally contained in a container stains the inside of the container. It sometimes happens that the stains are almost or completely hardened.

In such a case as above, the stains are washed off by using a volatile solvent such as alcohol, toluene, etc. depending on the contents of the container, or by using appropriate cleaning agent. Generally, the stains are removed by scrubbing the inside (Though the outside may be stained, there is almost no problem in achieving the above-mentioned aim of reuse.) of the bottom and the peripheral wall with a brush. However, this kind of handwork requires much time and effort to scrape off hardened resinous paints and so on, wherefore can not meet a requirement to clean handreds of drum containers a day. Furthermore, it has such problems that the volatile solvent itself used to remove the stains is harmful to human body, and that the prevention of explosion has to be considered.

From the above-mentioned point of view, the inventors of this invention considered introducing a technology of using blast, which is harmless and safe, for exfoliation and removal of the above-mentioned paints and so on. In studying this kind of technology of using blast, the inventors noticed the existence of a cleaning method as disclosed in Japanese Patent Publication No. 6-24730.

According to a technology of this method for cleaning a metal mould, melamine resin powder is blasted together with air onto the surface of the metal mould, in order to remove stains of such a moulding material as rubber.

Before the technology became perfected, glass beads, corn powder, walnut powder, etc. had been used as blast materials. However, there were such problems that abraison was severe, exfoliating action was weak, dust control measures had to be taken, and work environment after use of these materials was deterioated. By using melamine resin powder instead of the above-mentioned materials, superior cleaning effect has been obtained without hardly lowering a temperature of the metal mould.

As a blast-method for exfoliation similar to the above-mentioned method, the existence of a blaster, for example, is noticeable in which fine particles used for repainting, etc., is blasted.

According to this technology, fine particles of sodium bicarbonate ($NaHCO^3$) are blasted to an object by pressurized air, and the shock generated thereby is used to exfoliate hardened resinous paint and the like. A cleaning apparatus according to this technology comprises a pressure tank which contains fine particles of a material, pressurized air, a valve for mixing pressurized air and the fine particles of the materials, and a nozzle from which the mixture of these is blasted, etc.

Use of the above-mentioned melamine resinous powder has a problem that leads to a pollution problem, because it is resin, unless secondary treatment after blast is done, in other words, unless it is collected and treated separately, Therefore, work of exfoliation costs much since cost of collection should be included.

In addition, hardness of the melamine resinous powder is comparatively higher than that of the above-mentioned sodium bicarbonate, wherefore there was a problem that the surface of the object is damaged when the melamine resinous powder is blasted with the pressurized air of 3 $kg/cm^2$~10 $kg/cm^2$. The melamine resinous may be used when rough finishing of the object is acceptable. However, there was a problem that is can never be used when the object was a special container made of aluminium alloy or thin steel, the surface was finished like a mirror, ot the object was plated or filmed.

In comparison with the above, use of the above-mentioned sodium bicarbonate is superior is respect that it has a characteristic of water-solublity, it is harmless and can be added in manufacturing process of food, and that hardness of the sodium bicarbonate is comparatively low wherefore softer hit of blast can be obtained compared to the melemine resinous powder.

The inventors of this invention has already proposed in Japanese patent application Nos. 8-292189 and 9-159108, the method and the apparatus for cleaning in which powder of sodium bicarbonate having these advantages is used as a cleaning agent.

The above-mentioned cleaning apparatus is basically so constructed that a cylindrical container (a drum) to be cleaned is rotated at a certain fixed speed with its axis being laid horizontally, a nozzle coming close to and remote away from the inside of the container from which powder of sodium bicarbonate is blasted against the inner surface of the container together with water spray. However, in use of the cleaning apparatus, first, there was a problem that effectiveness of cleaning (accuracy of exfoliation) does not improve by simply raising blast pressure or by increasing or decreasing the volume of use of the powder of sodium bicarbonate per time, in case the container is for ink, paint, or the like and in case the ink, the paint, or the like is hardened or unhardened. Further, since the blast nozzle goes into and out the container which is horizontally laid, the blast nozzle has to be bent. In a structure of the nozzle in which a stream way is formed at the ball joint available on the market, there was the second problem the stream-way becomes narrow because of the bend at the ball joint and the speed of flow of the powder of sodium bicarbonate is lowered.

Therefore, at first, the inventors considered that the effectiveness of cleaning is related to a degree of dryness of the ink to be refoliated, fineness of powder of the sodium bicarbonate, amount of pressured air, and a speed of blast, and carried studies. At the same time, a necessary arises that the blast nozzle of the ball-joint should be improved so that the speed of flow of sodium bicarbonate powder is not lowered.

Secondary, in the above-mentioned apparatus, the function of automatic control of the nozzle was not enough.

SUMMARY OF THE INVENTION

The first object of this invention is to provide a method of cleaning a container and an apparatus therefor having a nozzle mechanism, which is superior in cleaning function adaptable to those such as paints, ink and others, which are exfoliated.

The second object of this invention is to provide a control mechanism for adjusting a nozzle angle, which mechanism may be surely controlled.

To achieve the above first object, the method of cleaning a container according to this invention in which fine particles of sodium bicarbonate are blasted together with pressurized air towards a container of drum to exfoliate and clean a coated layer on the surface of the container, said method comprising; using the fine particles of sodium bicarbonate each having a substantial diameter of 200$\mu$~350$\mu$, setting a pressure of the air to be within a range of 2 Kg/cm$^2$~4 Kg/cm$^2$, using the air of 3.5 liters~4 liters per 1 g of the sodium bicarbonate, and blasting the air and fine particles of sodium bicarbonate at a speed of 170 m/sec.~335 m/sec.

In the present invention, it is preferable that an angle of blast of the fine particles of sodium bicarbonate with respect to the container is with a range of 45 degrees to 60 degrees.

To achieve the above object, in the apparatus of this invention having a mount base for mounting a container of drum in a state that the container is laid to make its axis horizontal, rotary drive means for rotating the container about its axis, spray means for spraying the fine particles of sodium bicarbonate as a cleaning agent inside the container, first spray-drive means for pushing and withdrawing the spray means laterally towards the inside of the container from an opening of the container, second spray drive means for moving the spray means in radial directions of the container, and pressure conveying means connected to the spray means for the fine particles of sodium bicarbonate, said spray means including a spray nozzle mechanism comrising a conduit for flowing a mixture of air and the fine particles of sodium bicarbonate, a hall joint connected to the conduit, and a nozzle body connected to the ball joint, said apparatus is charatacterized in that the ball joint of the spray nozzle mechanism provides a widened flow passage therein, an extended cover for covering bend of the ball joint, and a seal arranged inside the extended cover, so as to change an angle of the nozzle body at within a range of 25 degrees in up and down directions with respect to an axis of the conduit.

In the present invention, it is preferable that the spray nozzle mechanims is constructed to blast the fine particles of sodium bicarbonate each having a diameter of 200$\mu$~350$\mu$, under a pressure of air within a range of 2 Kg/cm$^2$~4 Kg/cm$^2$, with a spray speed within a range of 170 m/sec.~335 m/sec.

Further, it is preferable to further comprises a nozzle angle control mechanism for controlling an angle of the nozzle body.

Furhermore, it is preferable that the nozzle angle control mechanism comprises four air angle cylinders arranged in series and operated by magnet valves, an operation rod operated with push and withdrawl movements in an axial direction of the container by means of the four air angle cylinders, a supporting arm pivoted to a base end of the hollow ball joint to face upwards, which ball joint is connected to the conduit of the spray means, a swing arm pivoted to the nozzle body with an end thereof and pivoted to the spporting arm with another end thereof by mean of a pivot pin, a basket connected to the operation rod and having a slot into which said pivot pin is inserted and engaged slidably, thereby the angle of the nozzle body is operated swingably by stages with push and withdrawal movements of the operation rod by means of the four air angle cylinders which are operated by magnet valves.

According to this invention, it is found that where fine particles of sodium bicarbonate as a cleaning agent are blasted with pressured air to exfoliate paint or the like, effectiveness of of exfoliation is determined by multiple factors such as a diameter of fine particle of sodium bicarbonate, pressure of air, amount of air to be consumed, and speed of blast.

According to the method of this invention, it may obtain a substantial diameter of fine particle of sodium bicarbonate (200$\mu$ to 350$\mu$), pressure of air (2 Kg/cm$^2$~4 Kg/cm$^2$), a volume of air per 1 g of sodium bicarbonate (3.5~5 liters), and a speed of blast (170 m/sec.~335 m/sec.), and as a result, it becomes possible to greatly increase an efficiency of exfoliating and cleaning soft or unhardened paints, inks and the like which are difficult to exfoliation.

According to the apparatus of this invention, using a ball joint for a spray nozzle mechanism which needs angle variation, forming a widened flow passage in the ball joint, and providing an extended cover and a seal whch is arranged inside the extended cover, it may possible to obtain required swing angles of 50 degrees, so as to increase an efficiency of cleaning a container without lowering a spray speed of sodium bicarbonate with respect to the inside of the container.

Further, according to the apparatus of this invention, with provision of a nozzle angle control mechanism and considering a shape of a container, degree of dryness of the material to be blasted, and other factors, it becomes possible to adjust or control a suitable angle for spraying fine particles of sodium bicarbonate, automatically step by step and precisely by using four blast angle cylinders, so that an efficiency of exfoliation and cleaning may be increased.

Other advantages of this invention will be apparent from the description of the preferred embodiment accompanying the following drawings.

BRIEF DESCRIPTION OF THE DRAWINGS

The drawings show a preferred embodiment of an apparatus for cleaning a container according to this invention in which.

DETAILED DESCRIPTION OF THE PREFERRED EMBODIMENT

The preferred embodiment of a method of cleaning a container and an apparatus therefor according to this invention will be described below with reference to the drawings.

Figure 1:
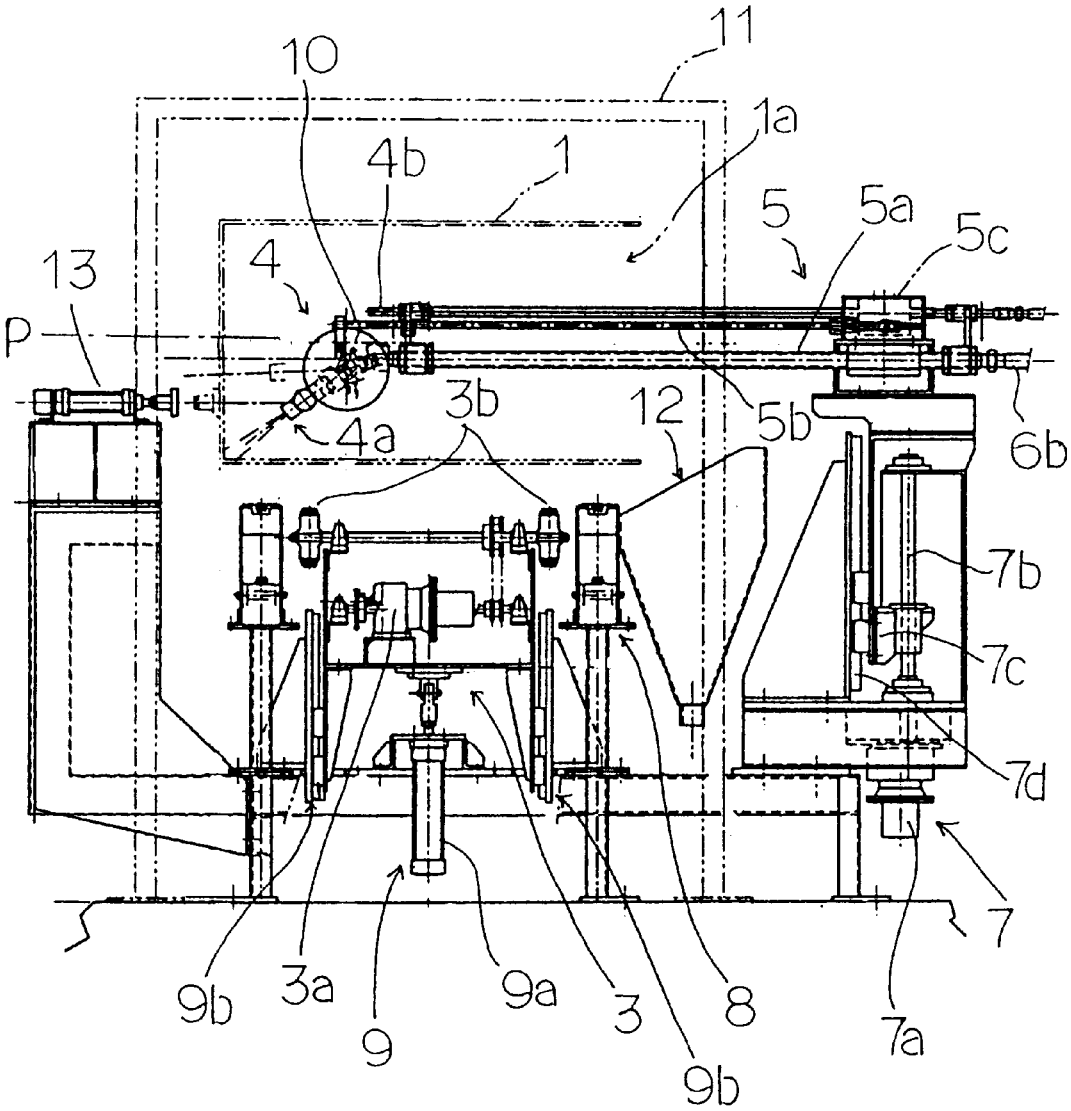
FIG. 1 is a brief front view of whole of the apparatus of this invention.
Figure 2:
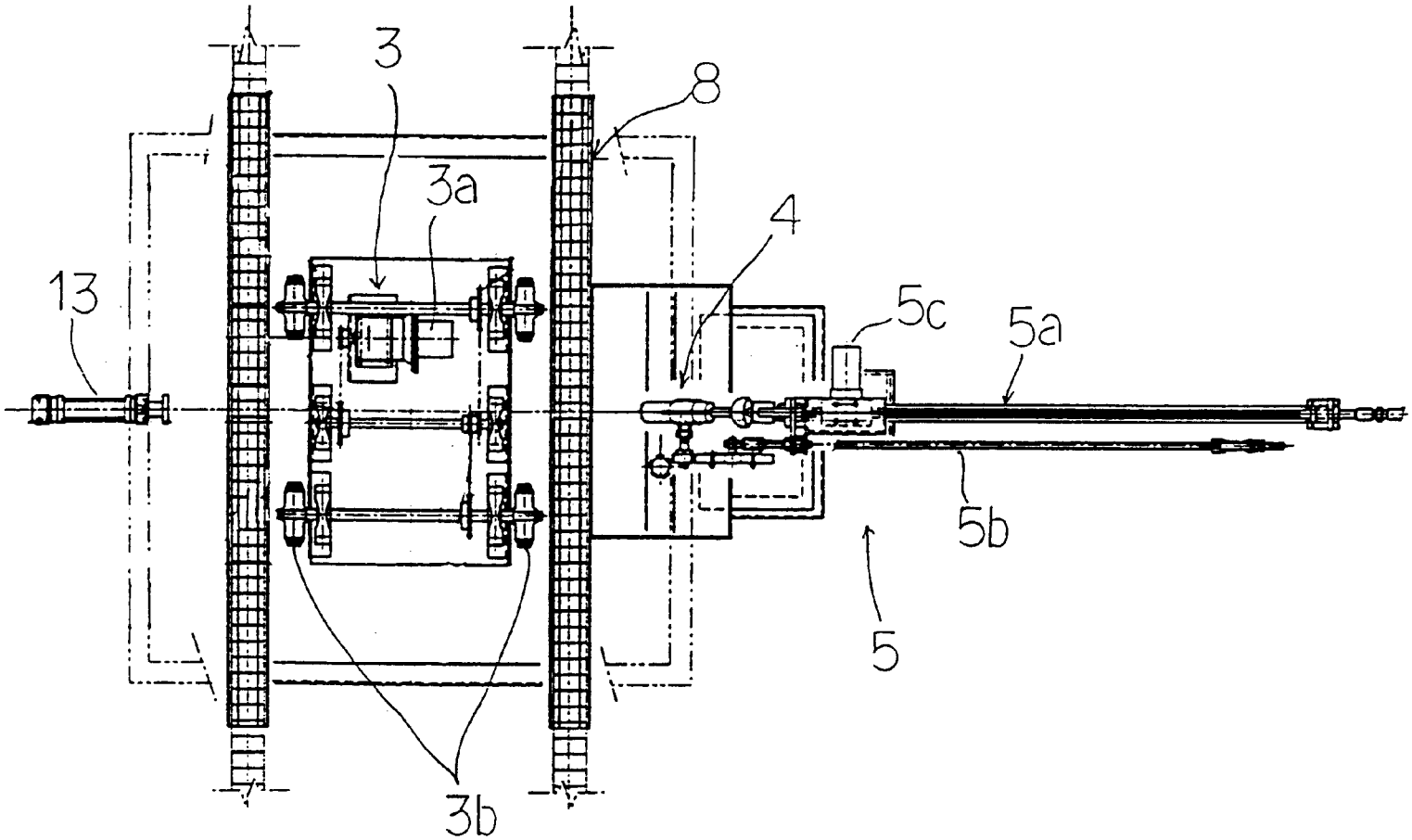
FIG. 2 is a brief plan view of whole of the apparatus of this invention.
Figure 3:
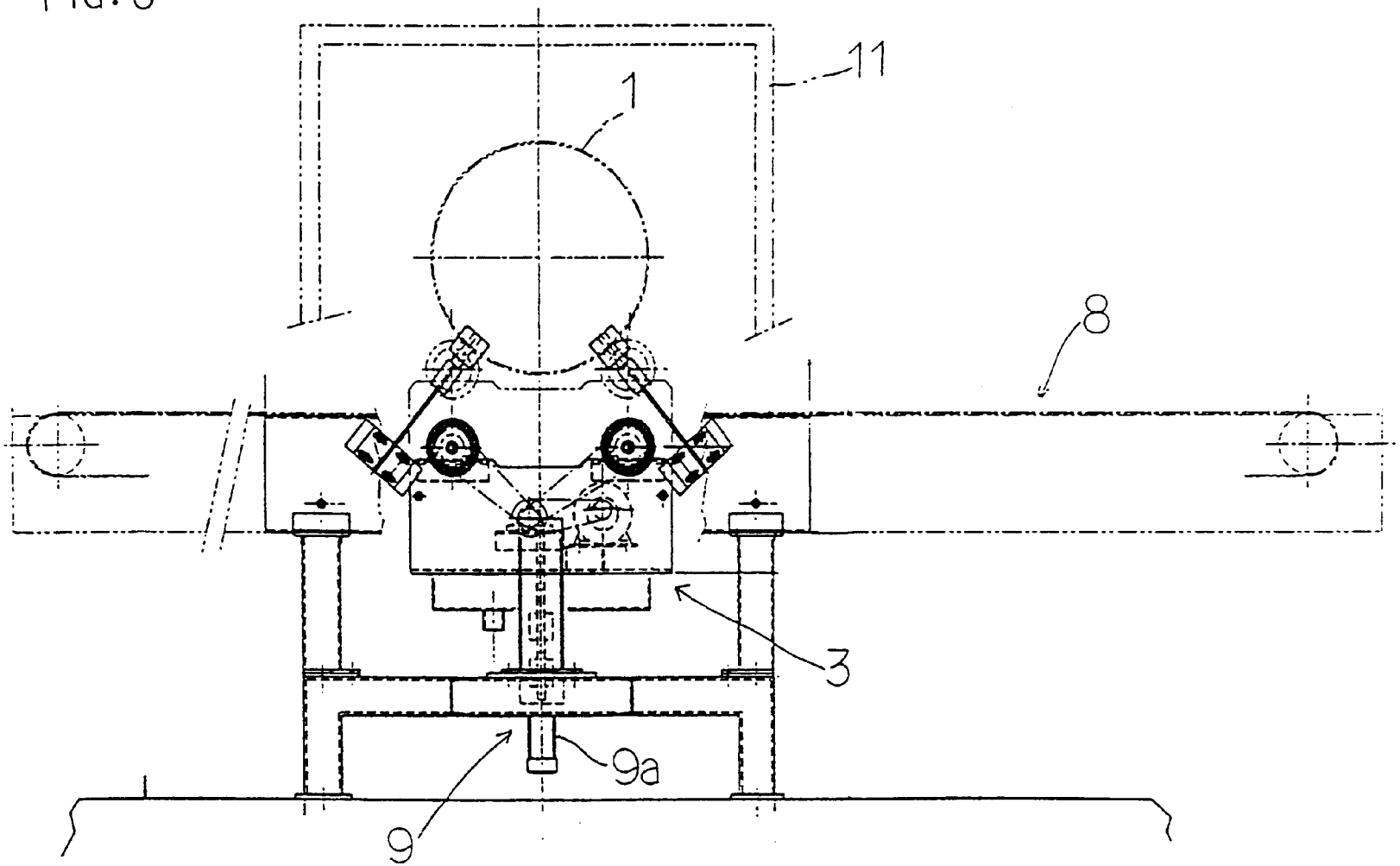
FIG. 3 is a side view of an essential portion of the apparatus partially broken away according to this invention.
Figure 4:
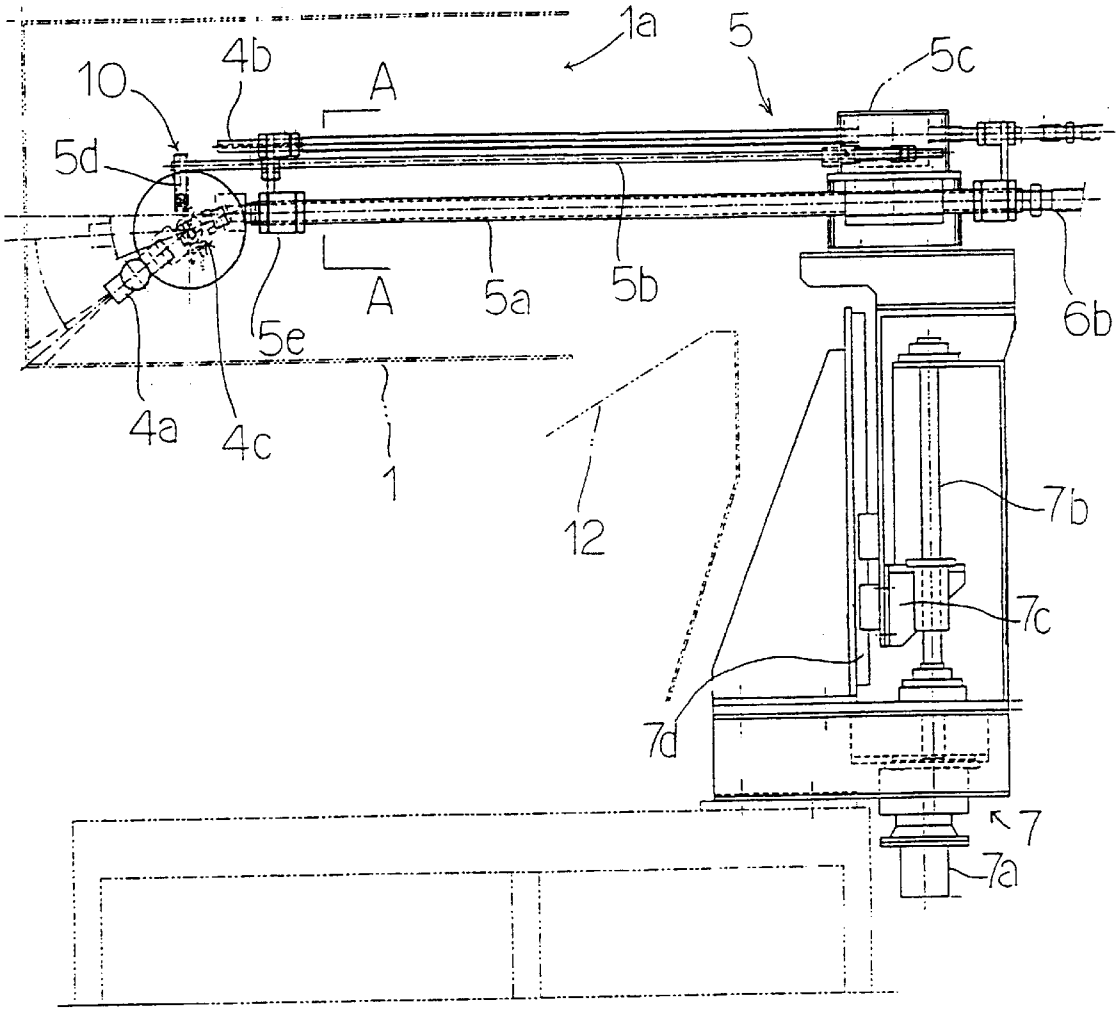
FIG. 4 is an enlarged front view of an essential portion of the apparatus according to this invention.
Figure 5:
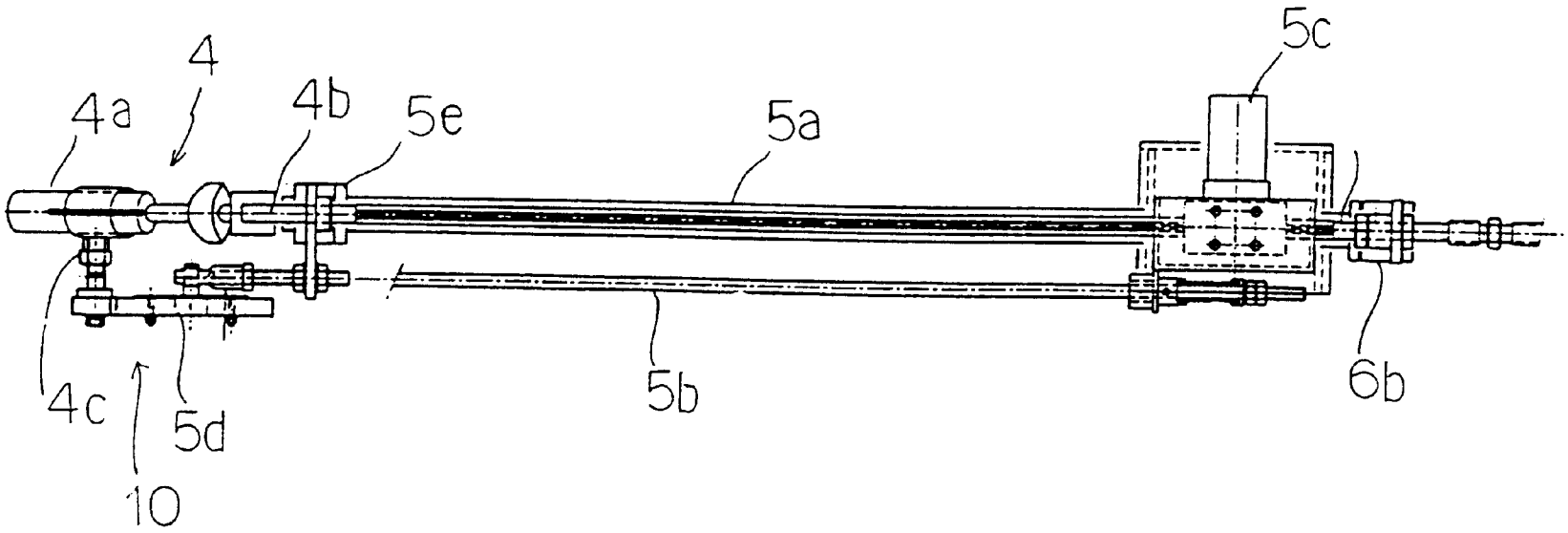
FIG. 5 is an enlarged plan view of an essential portion of the apparatus according to this invention.

As the apparatus of this invention, this embodiment explains about such a type for cleaing the inside of a drum as a container 1 for containing resinous paint. FIG. 1 is a brief front view of whole of the apparatus and FIG. 2 is a side view thereof partially sectioned.

The numeral 2 is a mount base for mounting the container 1 in such a state that the container I is laid so that an axis P of the container 1 is positioned to be substantially horizontal. The numeral 3 shows a rotary drive means to rotate the container 1 about its axis P. As the rotary drive means 3, an air motor 3*a* is used considering anti-explosion, and this motor drives a pair of rollers 3*b,* which are arranged in front and rear and righ and left, which rollers comprise a part of the mount base 2 for supporting the front and rear surfaces of the container 1 in a direction of its axis P, so as to rotate, for example, 2 or 3 times per minute. The numeral 8 is conveying means for conveying the container 1 to a cleaning position and moving the same therefrom in the state that the container 1 is laid, and this conveying means is driven by an air motor. Accordingly, it is possible to carry out convey to and stop of the container at a cleaning position, and conveying the same therefrom, with a suitable control system and with a simple drive system. Further, a holder 13 for supporting the container 1 is provided.

By the way, the conveying means 8 provides mounts for supporting and conveying the container 1 at its three positions thereof leaving a predetermined distance among them.

The conveyer of the conveying means 8 belongs to the prior art of an endless conveyer and therefore futher description about the conveyer is omitted here.

The numeral 9 shows elevating means for elevating the mount base 2 up and down with respect to the conveying means 8 at a cleaning position, and so constructed that it may receive the container 1 on the mount base 2 from the conveying means 8, and rase the container 1 upto a cleaning position. For the elevating means 9, an air cylinder 9*a* is utilized considering anti-explosion, and so constructed to rise the rotary drive means 3 and the mount base 2 together. The numeral 9*b* shows each of four guide members for supporting the rotary drive means 3 and the mount base 2, and stabilizing their elevating movements.

The numeral 4 is spray means for spraying and blasting fine particles of sodium bicarbonate into the inside of the container 1.

Figure 6:
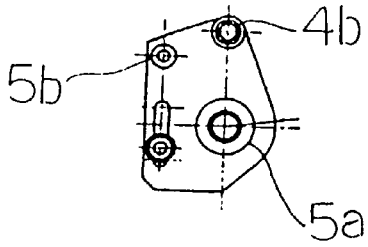
FIG. 6 is a sectional view of A—A lines in FIG. 4 of the apparatus according to this invention.
Figure 7:
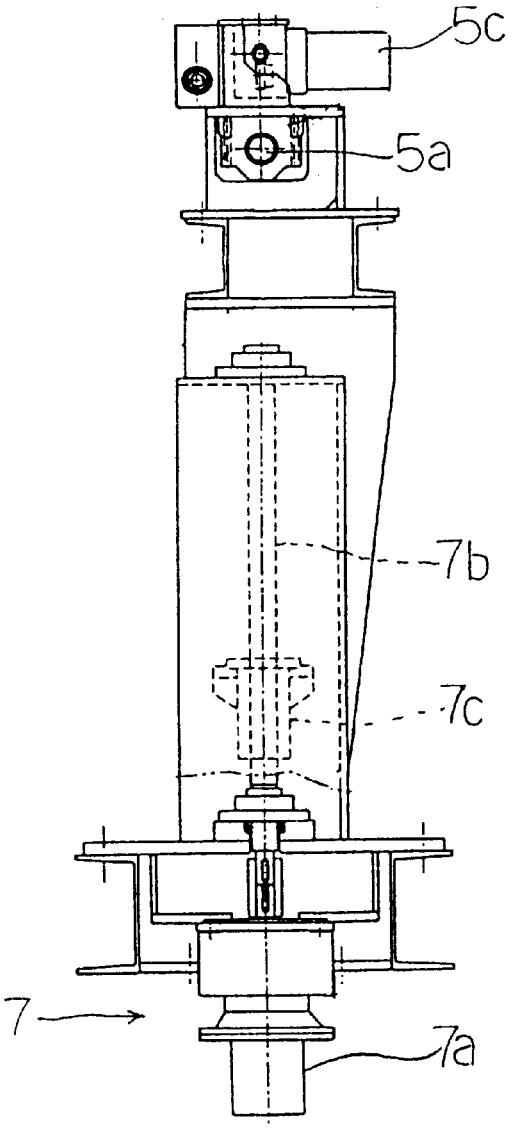
FIG. 7 is an enlarged side view of an essential portion of the apparatus according to this invention.

The numeral 5 is first spray drive means, and as shown in FIGS. 6 and 7, the first spray drive means comprises a rack gear 5*a* having a passage therein for passing the fine particles of sodium bicarbonate with pressurized air, a tip end of the rack gear being provided with the spray means 4, an electric motor 5*c* for driving the rack gear 5*a,* and a guide rod 5*b* arranged in parallel to the rack gear 5*a* to be slidable, whereby the spray means may go into and out the interior of the container 1 through an opening 1*a* of the container 1.

The spray means 4 comprises a nozzle 4*a* for spraying and blasting fine particles of sodium bicarbonate ($NaHCO_3$) with a pressurized air in a mixing state and a water nozzle 4*b* which is integral with the said nozzle 4*a*.

The first spray means 5 is so constructed to make the spray means 4 close to and remote away from the container 1. In this embodiment, the first spray means 5 is arranged to face the opening 1*a* and the rack gear 5*a* is arranged to be slidable along the axis P of the container 1 via the guide rod 5*b* and driven by the electric motor 5*c* so as to be movable in forwards and rearwards.

Figure 8:
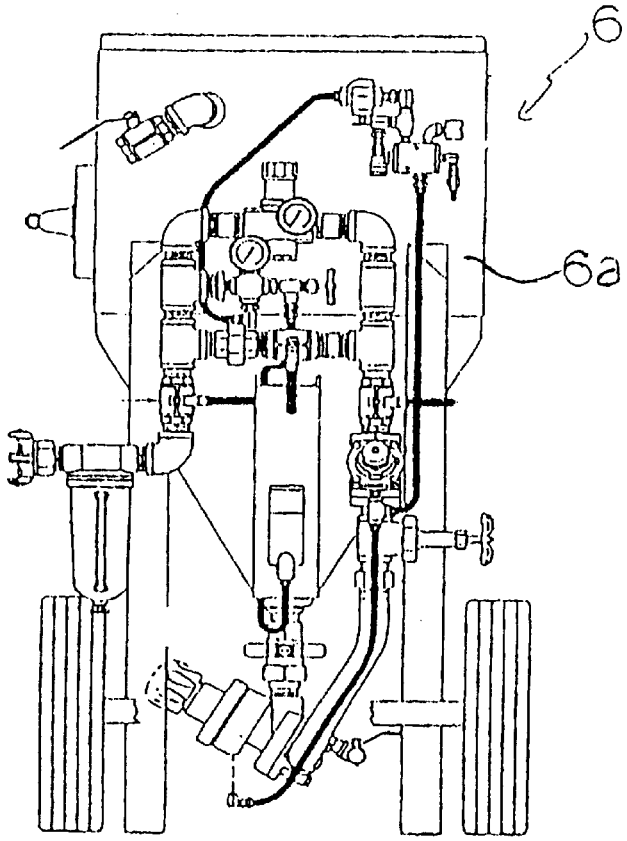
FIG. 8 is a front view of an essential portion of the apparatus according to this invention.
Figure 9:
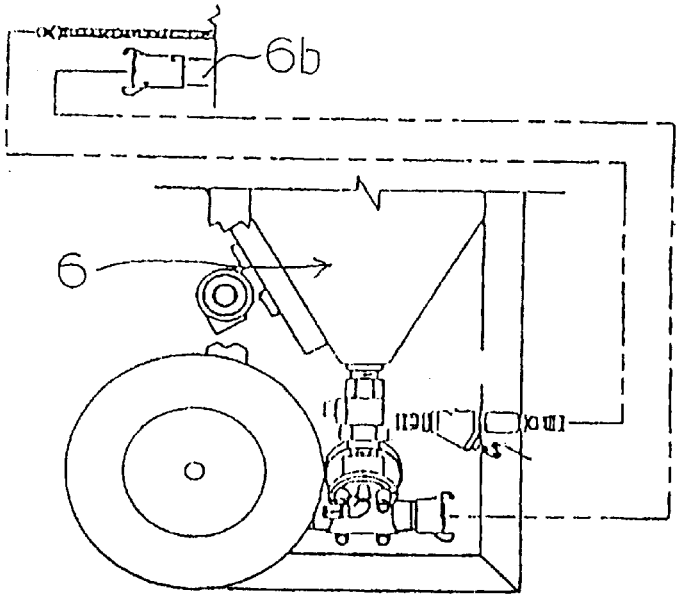
FIG. 9 is a side view of an essential portion of the apparatus partially enlarged, according to this invention.

As shown in FIG. 8, the numeral 6 is pressure conveying means connected to the spraying means 4, and in this embodiment, a well known blaster is used as the pressure conveying means. This blaster mixes fine particles of sodium bicarbonate, which is pooled in a pressurized tank 6*a,* with a pressurized air which is control led within a range of 2 $Kg/cm^2$~4 $Kg/cm^2$, from a pump (not shown) at a predetermined mixing ratio, and then transfers them to the nozzle 4*a* of the spray means 4 through a hose 6*b*, which is shown in FIG. 9 and FIG. 1. The nozzle 4*a* is attached to the rack gear 5*a* of the first spray drive means 5. Although the pressure conveying means 6 provides wheels to be movable, but it may be constructed to be a stationary type.

The numeral 7 is second spray drive means which move the spray means 4 in a radial direction of the container 1, and in this embodiment, it comprises an electric motor 7*a* which is arranged vertically with a frame which is fixed to a floor. Further, the second spray drive means may move whole of the spray means 4 including the nozzle 4*a*, the water nozzle 4*h* and the rack gear 5*a*, in a vertical direction, i. e. in a radial direction of the container 1. Here is used such a construction as the second spray drive means, that the electric motor 7*a* drives a screw shaft 7*b*, and a slide member 7*c* which is screwed with the screw shaft 7*b,* and whole of the spray means 4 is supported by the slide member 7*c,* and then it may movable in up and down along the guide rail 7*b* of the frame.

10 is nozzle angle control means for rotating or swinging the nozzle 4*a* which is pivoted. The nozzle 4*a* is provided to be rotatable about a horizontal or lateral axis which is perpendicular to a direction of an axial line of the rack gear 5*a*, and as a holder 5*e* for the guide rod 5*b* which is arranged near the tip of the rack gear 5*a,* goes forwards, the nozzle 4*a* is rotated at about 45 degrees around the horizontal axis, while a part of an arm 5*d* which is pivoted to a pin 4*c* which is arranged to project laterally of the nozzle 4*a*.

Thereby, the nozzle 4*a* and the water nozzle 4*b* change their directions from their lateral states towards a direction of the axis P of the container 1, so that it becomes possible to exfoliate and clean the bottom of the container 1.

In this embodiment, in a (leaning position where it is anticipated that fine particles of sodium bicarbonate spread, the conveying means 8 and the container 1 are covered by a chamber 11 which comprises a house frame and a plastic sheet and a suction blower (not shown) is provided for drawal, so that water, unsolved sodium bicarbonate as a cleaning agent and the exfoliated materials (paints) may be prevented from spreading and therefore it becomes easy to carry out treatment of the remaining materials thereafter.

Further, a bucket 12 is provided in a cleaning position to receive the water, unsolved sodium bicarbonate and exfoliated materials which are blasted in and flown from the container 1, and therefore the remaining materials flown down into the bucket 12 may be collected by means of a collector (not shown) in order to easily carry out their treatment thereafter.

In the embodiment of this invention, fine particles of sodium bicarbonate mainly comprise those each having a diameter substantially 300$\mu$, and those having a range of diameter from 200$\mu$ to 350$\mu$.

The pressure of air for blast and convey the fine particles of sodium bicarbonate is about 3.8 kg/cm$^2$ (G), and an amount of air is used in a range of 3.5 litters to 4 liters per 1 g of the fine particles of sodium bicarbonate.

Figure 12:
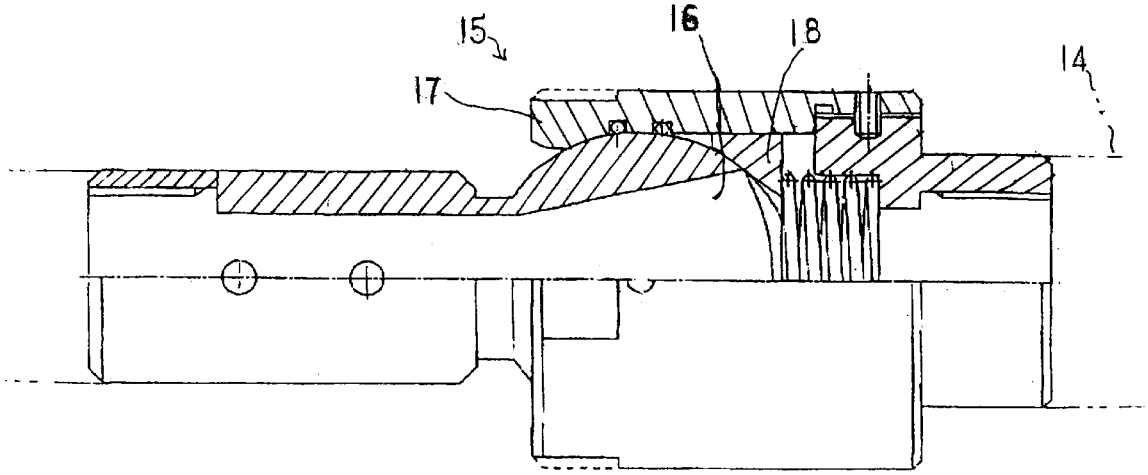
FIG. 12 is a side view of an essential portion of the apparatus partially sectioned, according to this invention.
Figure 13:
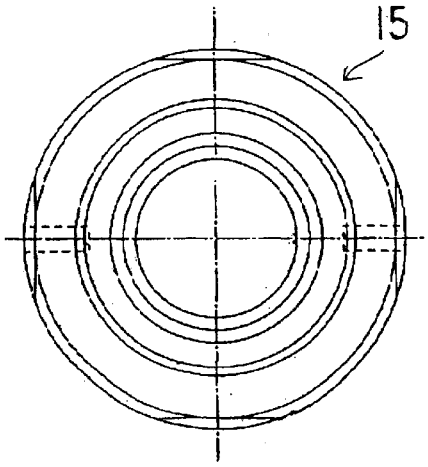
FIG. 13 is a side view of a spray zozzle of the apparatus according to this invention.
Figure 14:
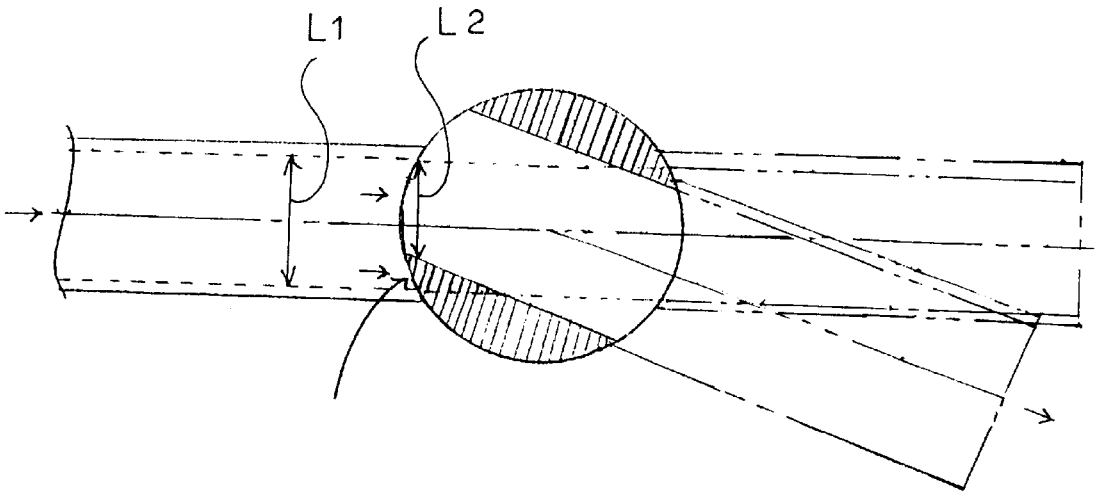
FIG. 14 (Prior Art)
FIG. 14 is a brief sectional side view of a spray nozzle according to the prior art.

The spray means 4 have a construction as shown in FIGS. 12 and 13, and it is integral with the rack gear 5*a,* and comprise a conduit 14 for flowing a mixture of the fine particles of sodium bicarbonate and the pressurized air, a ball joint 15 and a nozzle body 16 which is connected to the ball joint 15.

The ball joint 15 provides a widened passage 16 therein, an extened cover 17 for covering a wide angle of bend of the ball joint, and a seal 18 arranged inside the extended cover 17, so that the nozzle body 16 may change its angle to rotate or swing in a range of 25 to 25 with respect to an axis of the conduit 14 (namely 50 degrees in total).

With such a spray nozzle mechanism and fine particles of sodium bicarbonate, pressurized air and its volume to be consumed, a blast speed of the fine particles of sodium bicarbonate reaches a range of 170 m/sec.~335 m/sec. Such a blast is carried out a spray angle $\alpha$ of 45°~60°, with respect to the inside wall of the container I of drum, leaving a distance of 405 mm therebetween.

Figure 10:
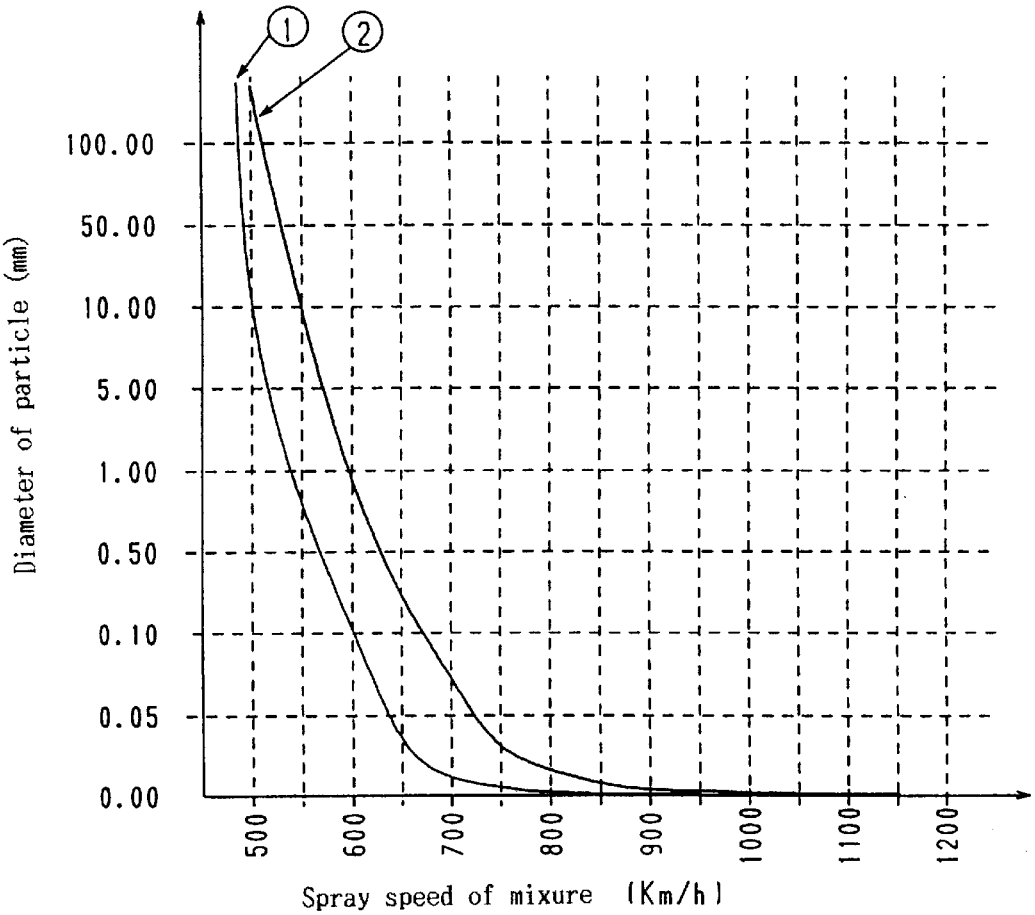
FIG. 10 is a graph explaining the result of cleaning of a container according to this invention.

FIG. 10 shows a graph showing the result of experiment. A curve ① shows a state of exfoliation of paint in such a case that the paint lowers its viscosity and progresses its dray, and a curve ② shows a state of exfoliation of paint in such a case that the paint has relatively a high viscosity and does not progress its dry. It will be apparent from both of the curves ① and ②, the paint hardened may be exfoliated and cleaned sufficiently with a lower speed of spray or blast rather than that of the paint which is still soft.

The vertical axis of the graph shows a diameter of the piece of paint which is exfoliated. It has obtained such a result that the paint is completely exfoliated with a blast speed of about 900 Km/h(about 250 m/sec.) in case that the paint is not dried. Further, the lateral axis of the graph shows a blast speed of a mixture of fine particles of sodium bicarbonate and air, in order to easily understant the relationship between both of the factors.

Figure 11:
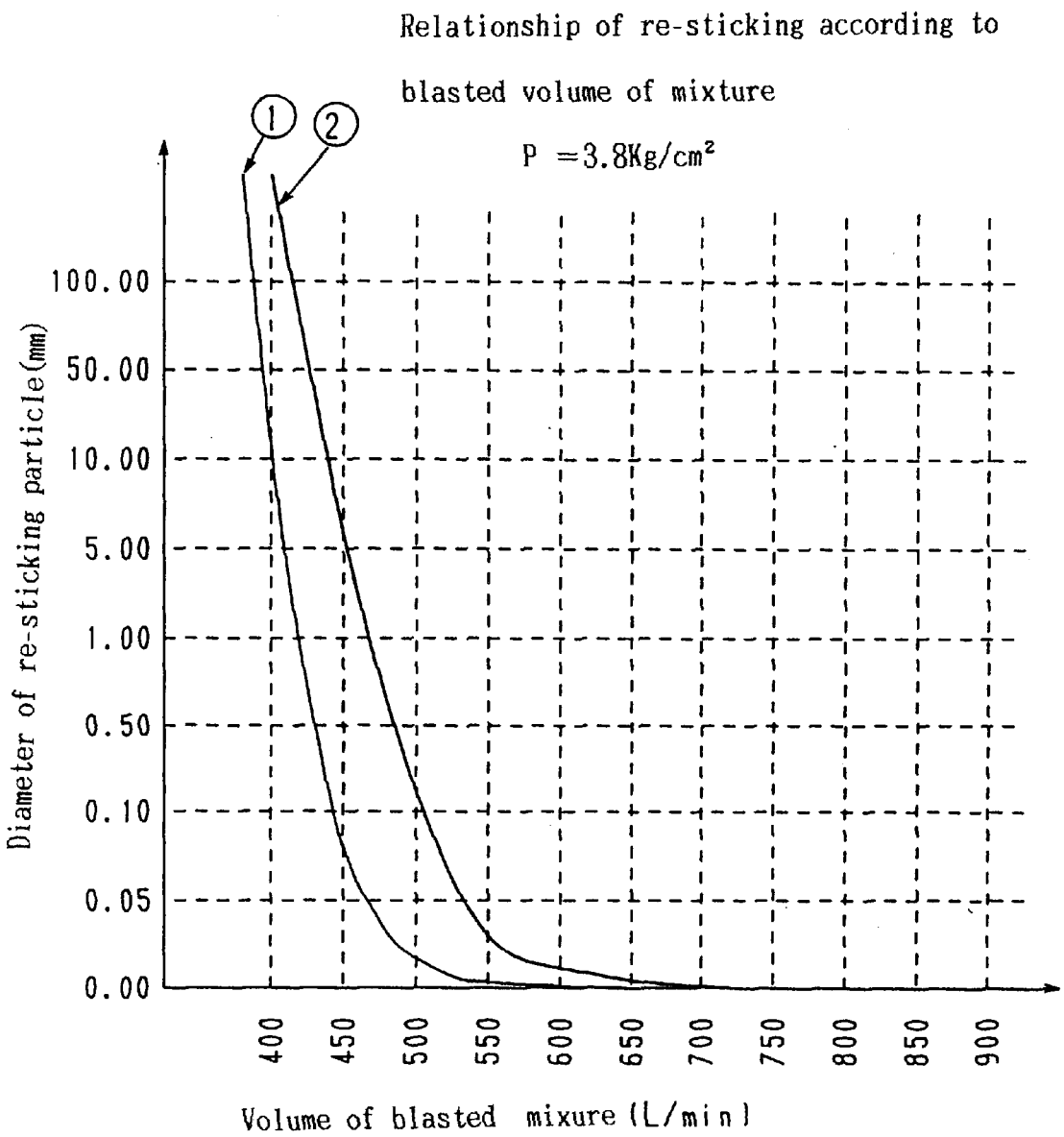
FIG. 11 is another graph explaining the result of cleaning of a container according to this invention.

FIG. 11 shows a graph showing the result of experiment. A curve ① shows a state of exfoliation of paint in such a case that the paint lowers its viscosity and progresses its drying, and a curve ② shows a state of exfoliation of paint in such a case that the paint has relatively a high viscosity and does not progress its dry.

From this graph, it will be apparent that an efficiency of exfoliation or prevention of re-sticking of the paint may increased from a point where the amount of air consumed exceeds 400~450 liters, and it may prevent re-sticking of the exfoliated paint with the air of about 700 liters if the paint is dried and hardened or not. Namely, in other words, it will be understood that it may obtain the efficiency of exfoliation or prevention of re-sticking of the paint by using an amount of air in a range of 3.5~4 liters per 1 g of sodium bicarbonate.

Accordingly, to obtain a sufficient fine particles of sodium bi carbonate and prevention of re-sticking of the paint, it is necessary that the diameter of fine particle of sodium bicarbonate is substantially in a range of 200$\mu$350$\mu$, that the pressure of air is in a range of 2 Kg/cm$^2$~4 Kg/cm$^2$, that the amount of air is in a range of 3.5~4 liters per 1 g of sodium bicarbonate, and that the blast speed is in a range of 170 m/sec.~335 m/sec. As a result of experiment, it is understood that it may obtain a good exfoliation in a state that the blast speed exceeds 335 m/sec., but as the blast speed is getting near a sonic speed or goes over a sonic speed, a sonic boom caused by sonic speed influences the spray means and therefore it is not preferable to increase the blast speed extremely.

Next, a nozzle angle control mechanism of this invention will be described in detail.

Figure 15:
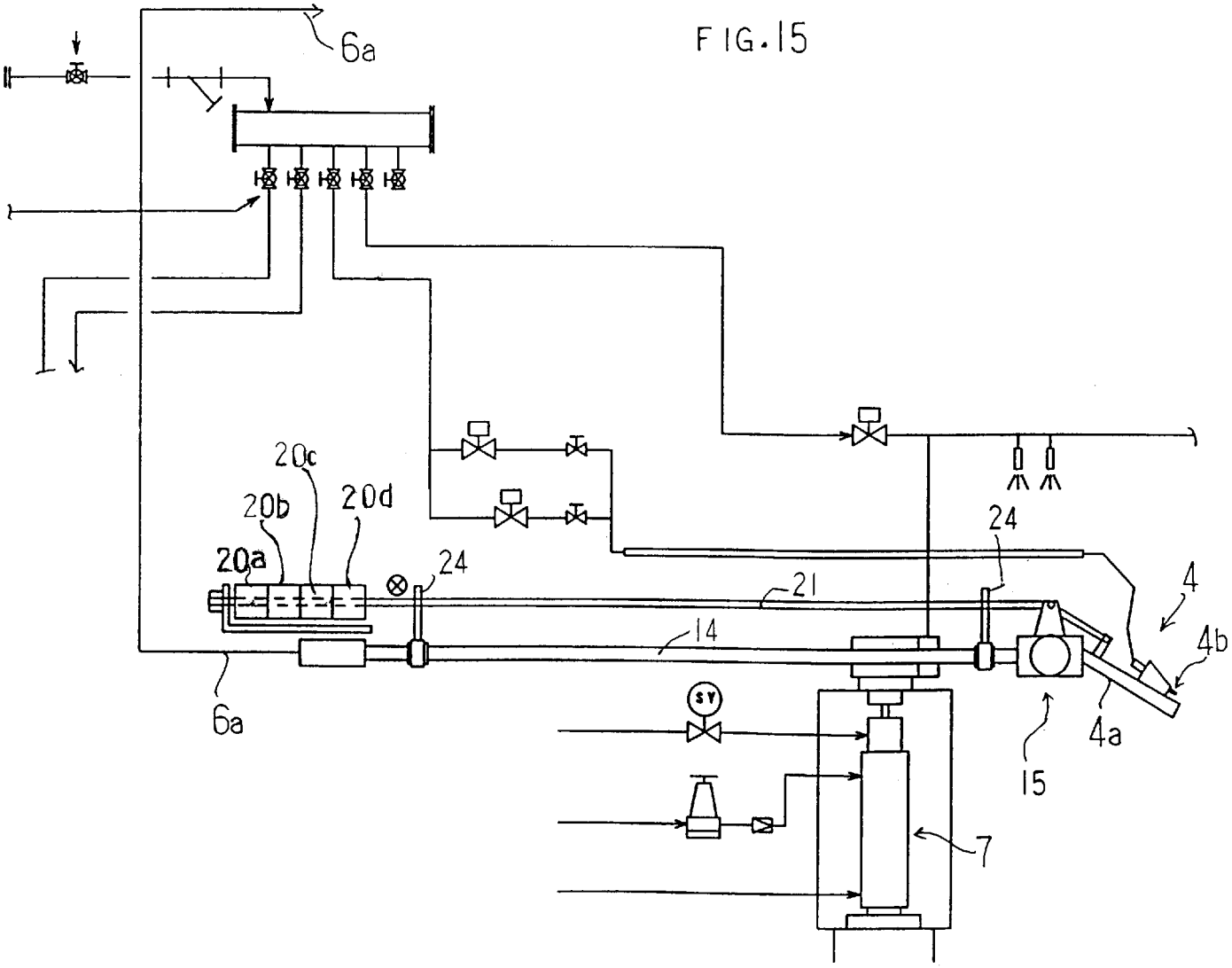
FIG. 15 is an operation diagram of a nozzle angle control mechanims for a spray nozzle of the apparatus according to this invention.
Figure 16:
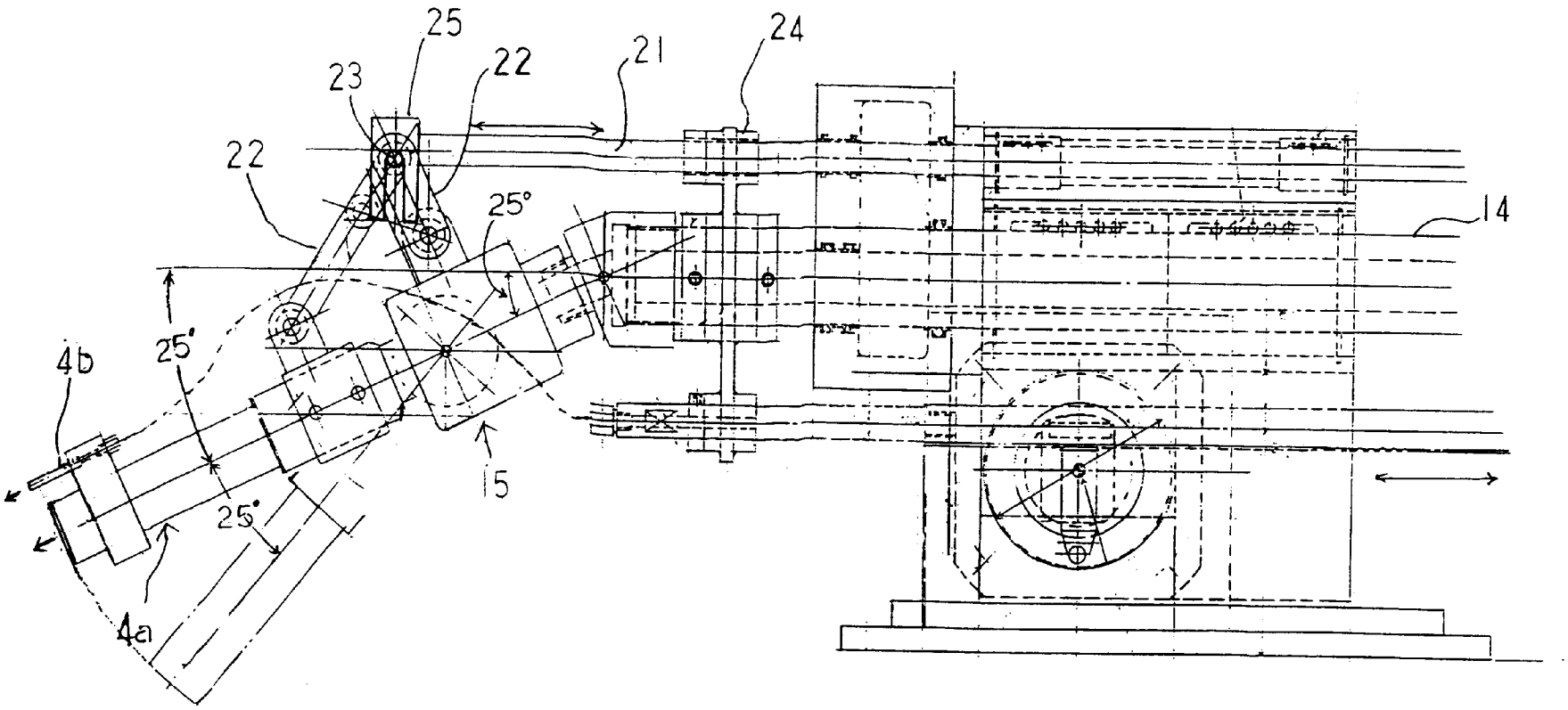
FIG. 16 is a side view of the nozzle angle control mechanims for a spray nozzle of the apparatus according to this invention.

As shown in FIGS. 15 and 16, four air angle cylinders 20*a,* 20*b,* 20*c* and 20*d,* which are operated by means of a magnet valve respectively, are arranged in series to make a predetermined stroke. The magnet valves are arranged in a control box for the purpose of anti-explosion so as to make operations for changing air flow, but it may use such a type which is integral with an air angle cylinder having a normal anti-explosion function though it is expensive. An operation rod 21 is provided to make push and withdraw movements in an axial direction of the container 1, by means of the air angle cylinders 20*a,* 20*b,* 20*c* and 20*d.* The numeral 24 is a bracket which is attached to the conduit 14, for slidably supporting the operation rod 21.

Further, a supporting arm 19 is pivoted to a base end portion 24 of the hollow ball joint 15 to face upwards, which ball joint is connected to the conduit 14 of the spray means 4. The supporting arm 19 and a swing arm 22, which is pivoted to the nozzle 4*a* with an end thereof, are also pivoted by a pivot pin 23, and the pivot pin 23 is engagingly inserted into a bracket 25 having a slot, which is fixed to the operation rod 21.

Thereby, the operation rod 21 are operated to make push and withdraw movements by stages so as to swing the nozzle 4*a* and control an angle of the nozzle 4*a.*

Further, the ball joint 15 is set inclinedly downwards at an angle of about 25 degrees with respect to the conduit 14 which is substantially horizontal, and therefore the ball joint is constructed to be swingable at an angle of about 25 degrees in up and down directions respectively from its central axis.

What is claimed is:

1. An apparatus for cleaning a container said apparatus comprising a base for mounting a container on the base with a horizontal axis of the container parallel with the base, rotary drive means for rotating the container about said horizontal axis, spray means for spraying fine particles of sodium bicarbonate as a cleaning agent inside the container, a first spray-drive means for pushing and withdrawing the spray means laterally along an inside of the container from an opening of the container, a second spray-drive means for moving the spray means in a radial direction of the container, and pressure conveying means connected to the spray means for spraying the fine particles of sodium bicarbonate, said spray means including a spray nozzle mechanism comprising a conduit for spraying a mixture of air and the fine particles of sodium bicarbonate, a hollow ball joint connected to the conduit, and a nozzle body connected to the hollow ball joint, the ball joint of the spray nozzle mechanism provides a a spray having a width greater than a flow passage therein, an extended cover for covering a bend of the hollow ball joint, and a seal arranged inside the extended cover, so as to change an angle of the nozzle body from about a range of 25 degrees in an up and down direction with respect to an axis of the conduit.

2. The apparatus of claim 1, wherein the spray nozzle mechanism is constructed to blast the fine particles of sodium bicarbonate in which each of the fine particles have a diameter from about 200 microns~to about 350 microns, under a pressure of air within a range from about 2 kilograms/centimeters square~to about 4 kilograms/centimeters square, with a spray speed within the range from about 170 meters/second~to about 335 meters/second.

3. The apparatus of claim 2, further comprising a nozzle angle control mechanism for controlling an angle of the nozzle body.

4. The apparatus of claim 3, wherein the nozzle angle control mechanism comprises four air angle cylinders arranged in series and operated by magnet valves, an operation rod operated with push and withdraw movements in an axial direction of the container by means of the four air angle cylinders, a supporting arm pivoted to a base end of the hollow ball joint to face upwards, said hollow ball joint is connected to the conduit of the spray means, a swing arm pivoted to the nozzle body with an end thereof and pivoted to the supporting arm with another end thereof by mean of a pivot pin, a bracket connected to the operation rod and having a slot into which said pivot pin is inserted and engaged slidably, thereby the angle of the nozzle body is operated swingably by stages with push and withdraw movements of the operation rod by means of the four air angle cylinders which are operated by said magnet valves.

* * * * *